US005632067A

United States Patent [19]

Lautenschläger

[11] Patent Number: 5,632,067

[45] Date of Patent: May 27, 1997

[54] DOOR-RELATED HINGE MEMBER FOR HANGING A CABINET DOOR

[75] Inventor: Horst Lautenschläger, Reinheim, Germany

[73] Assignee: MEPLA-Werke Lautenschläger GmbH & Co. KG, Germany

[21] Appl. No.: 628,573

[22] Filed: Apr. 4, 1996

[30] Foreign Application Priority Data

May 3, 1995 [DE] Germany ..... 195 16 084.3

[51] Int. Cl.[6] ..... E05D 5/00

[52] U.S. Cl. ..... 16/383; 16/382

[58] Field of Search ..... 16/383, 382, 388, 16/387, 272, 261, DIG. 40

[56] References Cited

U.S. PATENT DOCUMENTS

| | | | |
|---|---|---|---|
| 4,085,481 | 4/1978 | Lautenschlager | 16/383 |
| 4,622,716 | 11/1986 | Lautenschlager | 16/384 |
| 4,630,332 | 12/1986 | Bisbing | 16/382 |

FOREIGN PATENT DOCUMENTS

| | | | |
|---|---|---|---|
| 0610765 | 8/1994 | European Pat. Off. . | |
| 2231878 | 12/1974 | France | 16/383 |
| 2153426 | 7/1980 | Germany | 16/382 |
| 555009 | 10/1974 | Switzerland . | |

*Primary Examiner*—Chuck Y. Mah

*Attorney, Agent, or Firm*—Dvorak and Traub

[57] ABSTRACT

The present invention is directed to a door-related hinge member having a cup-like portion to be sunk in a substantially circular mortise (28) in the back of a door (30) and having a flange (34) integral with the upper edge of cup-like portion. At least two centering studs (36) extend from the bottom of the flange and engage in two holes (38; 38') situated near the mortise. The hinge member is installable on at least two doors which are different as regards the position of the holes for the centering studs, the studs are provided in an area of the flange (34) in which the flange, when in the correctly installed position, covers the holes of the differently configured doors (30). The centering studs are of such shape and size that their outer periphery contacts the wall of each of the holes (38; 38') in at least along a line, in each of the differently configured doors (30).

3 Claims, 2 Drawing Sheets

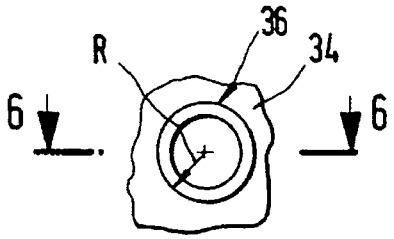
Fig.5
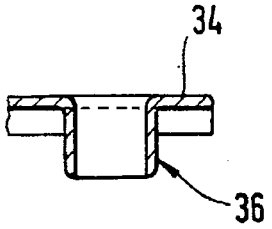
Fig.6
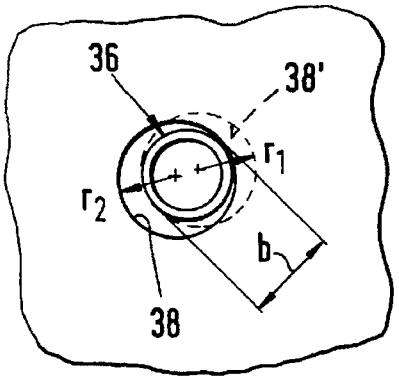
Fig.7
Fig.8
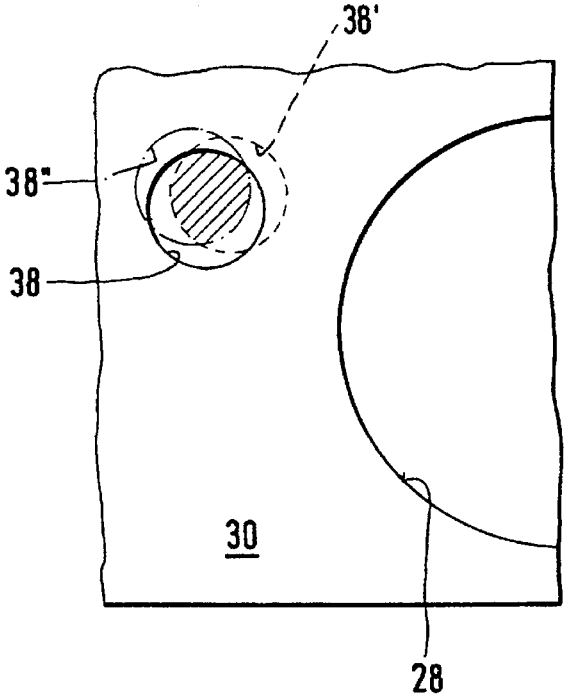

DOOR-RELATED HINGE MEMBER FOR HANGING A CABINET DOOR

BACKGROUND

The invention relates to a door-related hinge member having a cup portion which is to be sunk within a substantially circular mortise in the back of a door, the cup having on its rim an integral flange which extends beyond the cup part and lies against the back of the door, and which has at least two centering projections engaged in bores adjacent the mortise. This hinge member is designed to be installed on either of two doors which differ with regard to the position of the bores for the centering projections relative to the mortise.

The flange on the upper edge of the cup portion of furniture hinges assures that, when the hinge member is set in its mortise in the back of the door, the cup portion will be at the proper depth in its mortise when the flange lies against the back of the door. In other words, this correct depth will be achieved without complex measurement simply by the fact that the cup is pressed into the mortise until its flange lies against the back of the door. In order to assure that the hinge member will be properly oriented on the axis of the mortise (and of the cup part itself), studs project from the bottom of the flange on opposite sides of the mortise which enter into corresponding bores in the back of the door and fix or center the hinge member in its correct orientation. These centering studs can serve simultaneously for fastening the hinge member if they are oversize for the hole and can be hammered or pressed into the door, or also, after being inserted into the hole they can be spread open in the manner of an expansion plug. In such cases the flange can also be referred to as a fastening flange and the studs as fastening studs. In other cases, in which the fixation of the cup in the mortise is produced by protrusions disposed on lateral flats on the cup and made larger than the diameter of the mortise or by areas of the cup that can be forced outward, the studs projecting from the flange serve, as mentioned before, only to secure the correct orientation of the hinge member in the mortise. These studs are then mere centering studs which serve no fastening purpose and therefore they can be made shorter and weaker than fastening studs. At the same time, the size and position of the mortise in the door are, as a rule, the same for different hinges, while the position and size of the bores for receiving the studs, i.e., 'bore pattern' formed by the mortise and corresponding holes for the centering studs, can be different for special design reasons or for various specifications of the buyer of furniture hinges, i.e., the furniture manufacturer. Door-related hinge members which are similar as regards the cup part must therefore be made and stocked in several variants differing in regard to the shape and arrangement of the centering studs. This involves relatively high manufacturing costs, because production, e.g., by stamping and pressing from sheet metal or by pressure casting from metal, will require obtaining different tools or molds for each of the variants, and the investment costs can be pro-rated only on the variants they produce but not on the overall production.

The invention, on the other hand, is addressed to the problem of creating a door-related hinge member which is so designed that it can be used without special adaptation or reworking on doors of at least two different patterns of the bores with respect to the mortise that receives the cup.

SUMMARY OF THE INVENTION

Setting out from a door-related hinge member of the kind referred to above, this problem is solved by the invention in that the centering studs are provided in an area of the flange in which the flange, when in the correctly installed position, covers the holes of the differently designed doors, and that the centering studs are of such shape and dimensions that when they are in the holes their outer periphery will be in linear contact with a portion of the walls of the associated holes. Such a configuration of the hinge member is possible and appropriate for all those applications in which the mounting holes in doors at least partially overlap in the projection of the two hole patterns. Thus it is possible to provide centering studs on the flanges which will be of such shape and size that they can serve their centering purpose in the centering holes of the different doors. That these centering studs will then not be supported on their full circumference in their associated hole is no disadvantage, because the centering studs serve no fastening purpose and therefore do not have to transfer any forces between them and the wall of the hole.

In an advantageous embodiment of the invention, the centering studs can have a partially arcuate cross section rather than a circular shape, in which case the radii of the arcuate wall of the centering studs will correspond to the radii of the holes provided for the centering studs in the different hole patterns in relation to the centers of the holes with respect to the position of the central axis of the mortise of the associated door. In this embodiment the centering studs will make contact with an arcuate hole area of the wall of the hole.

As an alternative, an embodiment is also possible, in which the centering studs are circular in cross section and have a maximum diameter that is equal to or smaller than the minimum width of the overlap area covered by the holes of the different hole patterns. Then the thrust of the centering studs in each hole will be only on a line, but due to the fact that no forces need to be transferred between the centering stud and the fastening hole this is acceptable.

The centering studs are preferably integral with the flange, e.g., they are integrally cast if the hinge member is made by pressure casting from metal.

If, on the other hand, the hinge member is made by stamping and pressing from sheet metal, the centering stud can be pressed out of the material of the flange itself.

BRIEF DESCRIPTION OF THE DRAWINGS

The invention is further explained in the following description of several embodiments in conjunction with the drawing, wherein.

DETAILED DESCRIPTION

Figure 1:
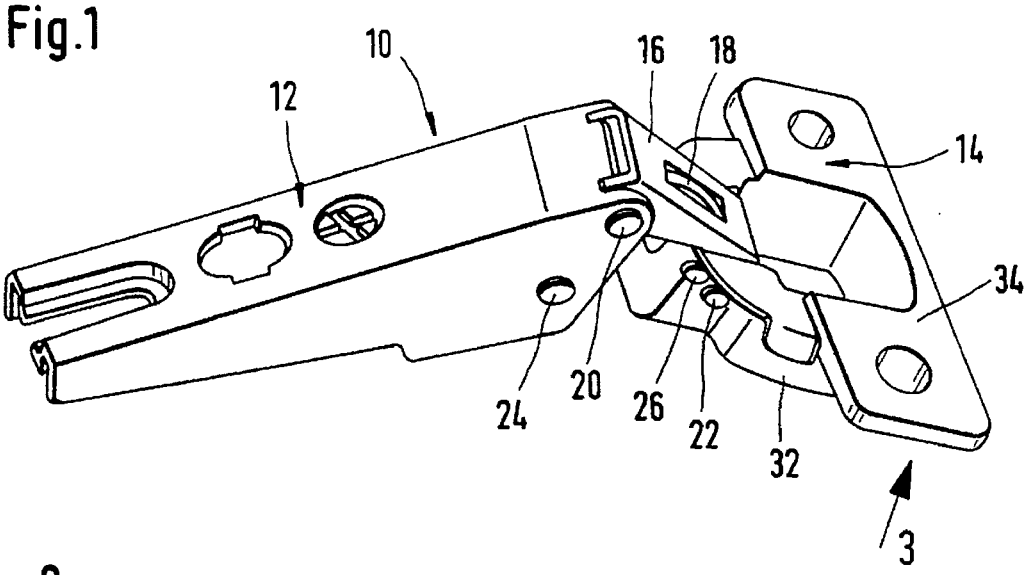
FIG. 1 shows a cabinet hinge with a schematically represented door-related hinge member of the kind involved in the embodiment of the invention, in the form of a sheet-metal cup member, FIG. 2 a plan view showing a portion of the back of a door close to the edge, the circularly defined mortise to accommodate the cup part, and the holes for the centering studs of a hinge member configured in the manner of the invention, and also showing in broken lines the position of the holes of the centering studs for a door having a different hole pattern, FIG. 3 an enlarged view of the underside of the flange as seen in the direction of the arrow 3 in FIG. 1.

In FIG. 1 there is shown a hinge, identified as a whole by the number 10, in the form of a so-called four-joint hinge, which is composed of a supporting arm 12 of inverted U-shape in cross section, which can be fastened adjustably on a mounting plate previously installed on the wall of a cabinet, and a hinge member 14 with a cup which can be fastened in a mortise in the back of a door, these being coupled together and pivoted at their extremities on the arm 12 and in the hinge member 14 by links 16 and 18 such that the hinge member 14—and thus a door fastened to it—can be swung from the open position represented in this figure to a closed position (not shown). The outer hinge link 16, which is visible in the open position, has the form of an elongated rectangular strip of sheet metal to the opposite longitudinal margins of which ear-like sections bent at right angles are attached in both end areas, which contain holes aligned with one another forming pivot holes on the supporting arm and cup ends. By means of a pivot pin 20 held in aligned holes in the lateral flanges of the supporting arm 12 and in holes in the hinge link 16, the hinge link is attached pivotingly to the support arm, while its other end is pivoted within the cup 40 on one or two short pins 22 extending from the inside surfaces of the cup and engaging each in the holes provided at the cup end of hinge link 16. The inner hinge link 18, of which only a short portion is visible within a section of hinge link 16, is likewise pivoted by means of a pin 24 in arm 12 and a pin 26 in the hinge member 14.

Figure 2:
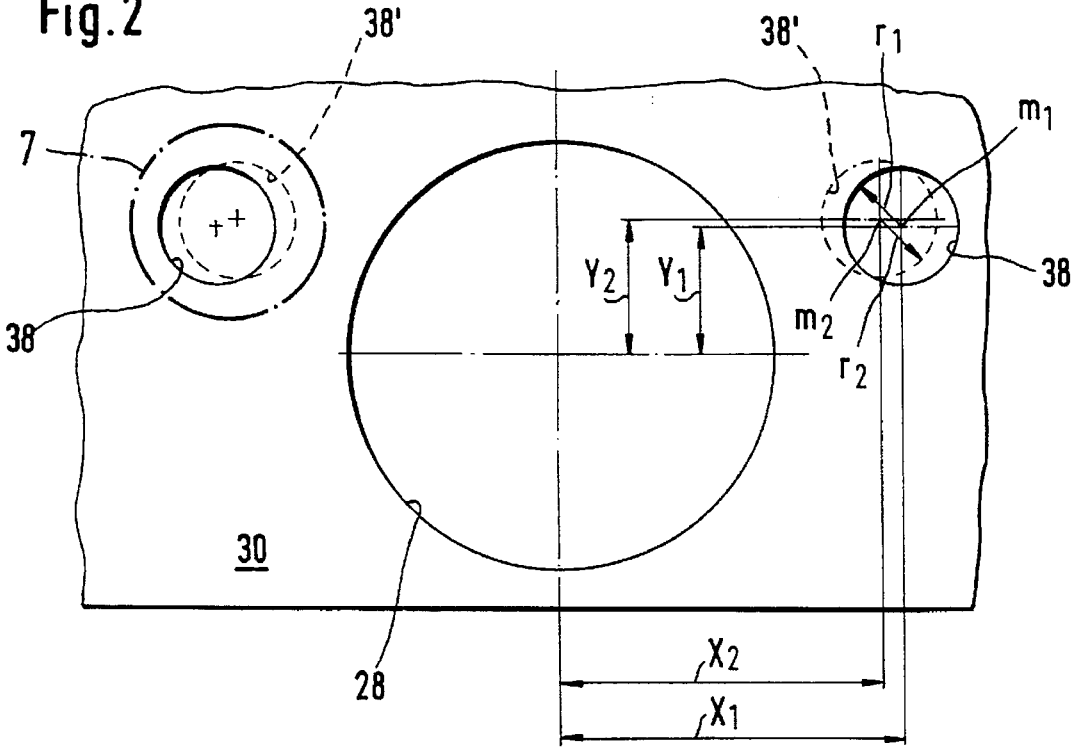
Figure 3:
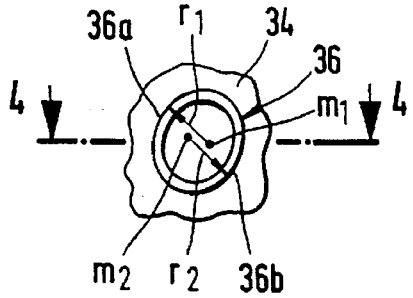

The hinge member 14 in turn is composed of the cup part 32 itself, which has flattened sides and is tub shaped or trough shaped, and can be inserted into the corresponding mortise 28 on the inner side of the door 30 (FIG. 2), plus a marginal flange 34 at right angles on its upper edge and extending in opposite directions, which is made smaller at its front on the supporting arm side, and is shaped in accordance with the associated portion of the mortise 28 such that, when in the proper position for fastening the hinge member 14 in the mortise 28, it fills the latter flush with the portion of the mortise 28 closer to the edge of the door and thus conceals the mortise. Centering studs 36 are created on the bottom of the flange 34 at a distance from the cup portion 32 itself, and they are intended to secure or center the hinge member 14, after it is introduced into the mortise 28, against rotation about the center of the mortise 28. In FIG. 2 the hole pattern of the mortise 28 and the two holes 38 in the door 30 is represented, and over the holes 38 holes 38' are represented in broken lines, which are related to a door with a different hole pattern, i.e., the positions of the holes in relation to the mortise 28 are different. It is apparent from the representation of the holes 38 and 38' as projected one over the other that the studs of these holes overlap partially. The centers $m_1$ and $m_2$ of holes 38 and 38' and of their coordinates $x_1$ and $x_2$, and $y_1$ and $y_2$ respectively, in relation to the center planes of the mortise at right angles and parallel to the edge of the door 30, are indicated in FIG. 2 with respect to the holes 38 and 38' situated on the right side. The position and shape of the corresponding centering stud 36 is then selected, as can be seen in FIG. 3, such that the centering stud 36 is not circular but defined by two sector-shaped walls **36*a*, 36*b*, the radii and radial centers of these portions 36*a* and 36*b* are plotted such that they coincide with the corresponding radii and radial centers $r_1$, $r_2$ and $m_1$, $m_2$ of holes 38 and 38' when the hinge member 14 is properly installed on the door 30. In this manner it is possible to install the hinge member 14 on doors 30 in which the hole pattern for the hinge member 14 has been chosen to match holes 38 or holes 38'**.

Figure 4:
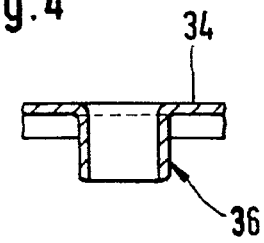
FIG. 4 is section seen in the direction of the arrows 4—4 in FIG. 3, FIG. 5 a view seen in the same direction as that of FIG. 3 of the bottom of the flange in a different embodiment, FIG. 6 a sectional view as seen in the direction of the arrows 6—6 in FIG. 5, FIG. 7 on an enlarged scale, a view of the area of the door that is situated in FIG. 2 within the dash-dotted circle 7 and is provided with a hole for a centering stud and additionally representing the dash-dotted stud of a hole pertaining to a different hole pattern, plus the location of the centering stud in the overlapping area of the holes after installation, and FIG. 8 the representation of a portion of the inside area of a door, corresponding basically to the left half of FIG. 2, in which two additional holes in a different position, one in a dash-dotted line and the other in a broken line, are projected onto the hole, represented by a solid line, for one of the centering studs.

FIGS. 5 and 6 are views corresponding to FIGS. 3 and 4 of the underside of the flange 34 of an alternative embodiment of a hinge member 14. It can be seen that in this embodiment the centering stud 36 is of a circular shape and its outside radius R is decidedly smaller than the radii $r_1$ and $r_2$ of the holes 38 and 38'.

In FIG. 7, in which the area situated within the dash-dotted circle 7 in FIG. 2, it can be seen that the diameter D (=2·R) of the centering stud 36 is selected just so that it fits into the overlapping area of stud of the two holes 38 and 38'. This means, therefore, that the diameter D must not be more than equal to the width, marked b in FIG. 7, of the overlapping areas of the studs of the holes 38 and 38'. The centering stud 36 configured in this manner will then lie only against a linear wall area at the associated hole 38 and 38'.

Lastly, in FIG. 8, two additional holes 38' and 38" are additionally shown in a representation of a section of a door 30 corresponding to the left half of FIG. 2, with the hole pattern of the mortise 28 and a corresponding hole 38; these holes correspond to different patterns of cups 14. Hole 38' is represented by a broken line, the same as in FIG. 2, and the additional third hole is indicated by a dash-dotted line. Since the positions of holes 38, 38' and 38" is such that the projection of all the holes onto one another results in a common area that is shaded in FIG. 8, it is therefore possible also to develop a hinge member 14 with centering studs which can be installed in doors having all three different hole patterns. The only requirement is that the centering studs be disposed on the bottom of the mounting flange 34 and that they be configured in their external shape so that they correspond in projection to the area hatched in FIG. 8 or have at least one line contact with the walls of the hatched area when the cup is in the installed state.

It is evident that modifications and further developments of the embodiments described can be realized within the scope of the invention. In the embodiments represented, the hinge member 14 is stamped and pressed from sheet metal, and the centering studs 36 are made integrally from the material of the flange and embossed during the production of the cup. If the hinge member 14 is made from metal by pressure casting, for example from a zinc alloy, the centering studs 36 can of course be made integral and in suitable shape and position on the flange 34. Alternatively, too, the centering studs can be made separately and then installed on the bottom of the fastening flange. It is also to be noted that here only the configuration and the location of the centering studs on the hinge member 14 is described, while the configuration of the hinge cup otherwise, especially in regard to its configuration permitting independent fastening in the mortise 28, is not shown and discussed, since how the hinge member 14 is fastened in the mortise 28 is not subject matter of the present invention. It is possible, however, by means of the earlier mentioned configuration wherein wedges are made oversize with respect to the mortise 28, or expanding wedges, can be provided on the cup portion 32, if fastening is to be made in this manner. Also, additional designs are known in the state of the art, in which, prior to installation, fastening means are retracted into the projection of the mortise and pushed forward or turned into the wall of the mortise after insertion into the latter.

What is claimed is:

1. A door-related hinge element installable on at least two different doors having different bore patterns, comprising;

a cup-like portion for setting in a substantially circular mortise in the back of either of the doors, an integral flange on an upper free edge of the cup-like portion for lying on the back of either door and at least two centering studs on the integral flange of the cup-like portion for engaging bore holes of the different bore patterns in the back of either of the doors adjacent the mortise, wherein the centering studs are provided in an area of the flange in which the flange covers the bore holes of either door when properly installed, and the centering studs are of such shape and dimensions that their outer periphery is contactable with the walls of the bore holes of either door at least in a linear manner, and wherein the centering studs have a cross section departing from a circular shape, said cross section being defined by at least a first arcuate section having a first radius and a second arcuate section having a second radius, wherein each of the radii of the arcuate sections has a different radius center, such that either of the arcuate sections is contactable with the walls of the bore holes of each of the different bore patterns when properly installed.

2. The door-related hinge element according to claim 1, wherein the centering studs are integral with the flange.

3. The door-related hinge element according to claim 2, wherein the hinge element is stamped and pressed from sheet metal, characterized in that the centering studs are pressed out of the material of the flange.

* * * * *